United States Patent [19]

Bachrach

[11] Patent Number: 4,612,945

[45] Date of Patent: Sep. 23, 1986

[54] COMB

[75] Inventor: Frank Bachrach, Great Neck, N.Y.

[73] Assignee: American Comb Corporation, Paterson, N.J.

[21] Appl. No.: 703,428

[22] Filed: Feb. 20, 1985

[51] Int. Cl.[4] ..... A45D 24/30

[52] U.S. Cl. ..... 132/137; 132/142

[58] Field of Search ..... 132/11 R, 126, 137, 132/138, 142, 152, 159, DIG. 1, 1 R; 15/159 A

[56] References Cited

U.S. PATENT DOCUMENTS

| | | | |
|---|---|---|---|
| 757,042 | 4/1904 | Ingram | 132/100 |
| 893,242 | 7/1908 | Homeier | 132/154 |
| 1,255,601 | 2/1918 | Hare | 43/134 |
| 1,305,226 | 5/1919 | Kunkler | 132/11 |
| 1,576,041 | 3/1926 | Du Priest | 132/158 |
| 1,642,916 | 9/1927 | Anderson | 132/163 |
| 1,958,802 | 5/1934 | Seaman | 132/125 |
| 2,236,446 | 3/1941 | Pucci | 132/160 |
| 2,276,886 | 3/1942 | Smith | 128/297 |
| 2,305,969 | 12/1942 | Larson | 132/18 |
| 2,317,485 | 4/1943 | Rider | 15/159 A |
| 2,395,002 | 2/1946 | Kemmer | 132/18 |
| 2,598,330 | 5/1952 | Wilson | 132/159 |
| 2,626,618 | 1/1953 | Collison | 132/20 |
| 2,655,925 | 10/1953 | Ulvad | 132/18 |
| 3,057,367 | 10/1902 | Langley | 132/161 |
| 3,216,428 | 11/1965 | Hallnan | 132/136 |
| 3,797,506 | 3/1974 | Reinsch | 132/137 |
| 4,206,771 | 6/1980 | Heinlein | 132/11 R |
| 4,502,498 | 3/1985 | Saferstein | 132/137 |

*Primary Examiner*—Paul J. Hirsch

*Attorney, Agent, or Firm*—Arthur Dresner

[57] ABSTRACT

A comb for removing lice and nits from the hair is formed by a base and a plurality of teeth extending from said base in substantially the same direction. The longitudinal axis of each tooth is parallel to the longitudinal axis of each other tooth. Each tooth has a polygonal cross sectional shape as in the form of a triangle. The cross sectional dimensions of each tooth enlarge from the free end of each tooth toward the base so that the spacing between adjacent teeth narrows toward the base. The facing edges of adjacent teeth interact with each other to capture, in a scissor-like manner, lice and nits therebetween.

5 Claims, 6 Drawing Figures

COMB

FIELD OF THE INVENTION

The present invention relates generally to the field of combs and more particularly to a comb having uniquely designed teeth particularly useful for removing lice and nits from hair.

BACKGROUND OF THE INVENTION

Heretofore lice combs have been formed simply by spacing adjacent teeth very close together so that lice or nits would be caught in the narrow space between adjacent teeth. The design of the teeth of such lice combs have typically been no different than the designs of teeth of any other styling type comb having a cross sectional shape which has traditionally been oval or sometimes rectangular. While this type of lice comb has been somewhat effective, there has always been the danger of not being able to remove all of the unhatched eggs or all of the hatched eggs of lice from the hair as a result of the eggs slipping through the comb in the space between adjacent teeth since such teeth typically have flat or slightly curved opposing faces.

Recent attempts at overcoming the disadvantages of the prior lice comb designs have involved creating teeth with portions that overlap into the spacing between adjacent teeth so as to further narrow this spacing. The result has been combs having teeth with complicated cross sectional shapes thus making the creation of molds for producing plastic combs complicated and expensive. In addition, such design tends to render the teeth susceptible to easy breaking.

It is accordingly a principal object of the present invention to provide a comb useful for removing lice and nits from hair which generally overcomes the disadvantages of the prior art.

A more specific object of the present invention is to provide such a comb having teeth which are triangular in cross sectional shape in which the cross sectional dimensions of such teeth enlarge toward the base of the comb so that spacing between facing edges of adjacent teeth continually narrows to assure catching all lice and nits.

Yet a further object of the present invention is to provide a comb having teeth with interacting adjacent facing edges which serve to capture in a scissor-like manner lice and nits.

Other objects, features and advantages of the present invention will become more apparent from the detailed description of the invention in conjunction with the accompanying drawings to be described more fully hereinafter.

SUMMARY OF THE INVENTION

The foregoing objects of the present invention are generally accomplished by providing a comb for removing lice and nits from the hair formed by a base and a plurality of teeth extending from said base in substantially the same direction with the longitudinal axis of each tooth being parallel to the longitudinal axis of each other tooth. Each of the teeth has a triangular cross sectional shape. The cross sectional dimensions of each tooth enlarge from the free end of each tooth toward the base so that the spacing between adjacent teeth narrows toward the base. The edges of adjacent teeth thus interact to capture in a scissor-like manner lice and nits.

BRIEF DESCRIPTION OF THE DRAWINGS

The foregoing and other features of the present invention are more fully described with reference to the following drawings annexed hereto, in which.

DESCRIPTION OF THE INVENTION

Figure 1:
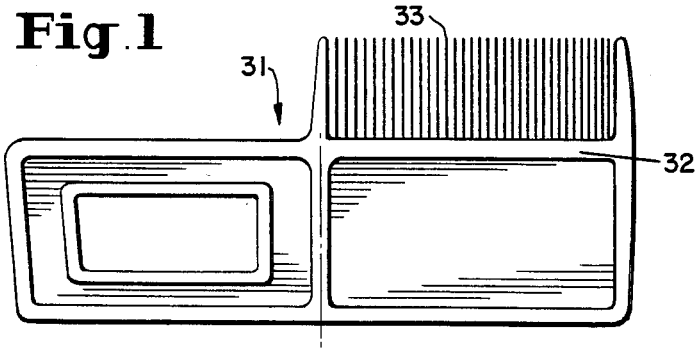
FIG. 1 is a side elevational view illustrating one form of a comb incorporating one embodiment of the present invention.
Figure 2:
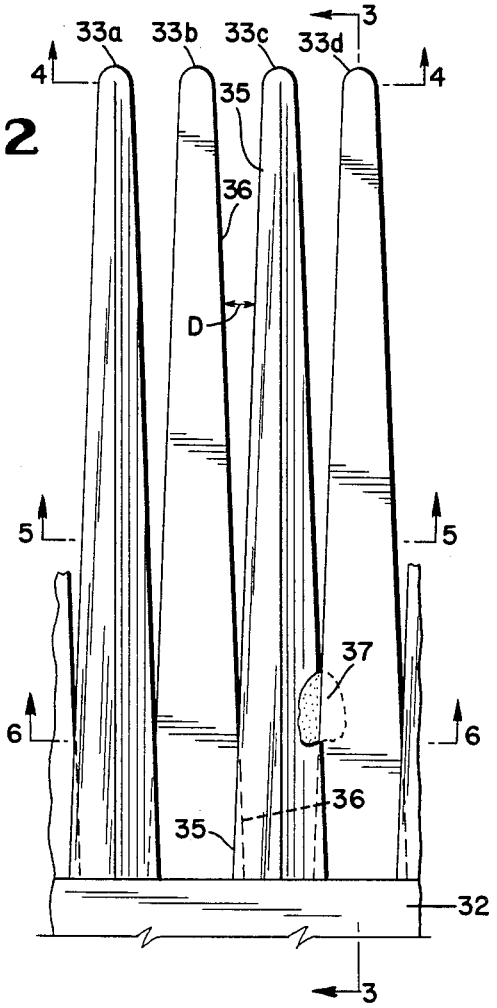
FIG. 2 is an enlarged side elevational view showing in detail some of the teeth of the embodiment of FIG. 1.

FIG. 1 illustrates a comb 31 incorporating the features of one embodiment of the present invention, which is generally formed by a base 32 and a plurality of teeth 33 which extend vertically upward as illustrated in FIG. 1 away from the base 32. The design of the teeth 33 which renders the present invention particularly effective is more clearly illustrated in FIGS. 2 through 6. FIG. 2 shows in an enlarged view teeth 33*a*, 33*b*, 33*c* and 33*d* extending from base 32 and aligned adjacent to each other. The longitudinal axis of each of these teeth is arranged parallel to each other.

Figure 3:
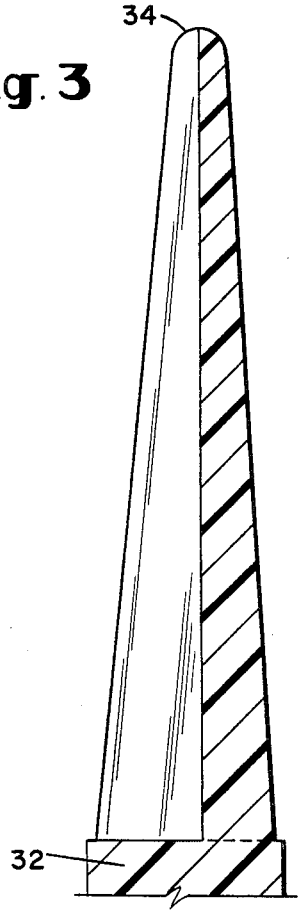
FIG. 3 is a sectional view taken along lines 3—3 of FIG. 2, but showing a second embodiment.
Figure 4:
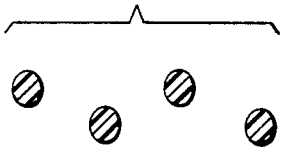
FIG. 4 is a sectional view taken along lines 4—4 of FIG. 2.

From FIGS. 2 and 3 it will also be noted that the top 34 of each of the teeth 33 is rounded in order to avoid any injury to the user.

Figure 5:
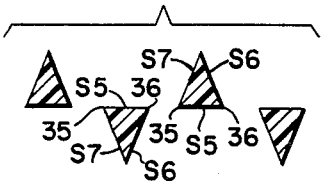
FIG. 5 is a sectional view taken along lines 5—5 of FIG. 2 showing the second embodiment.
Figure 6:
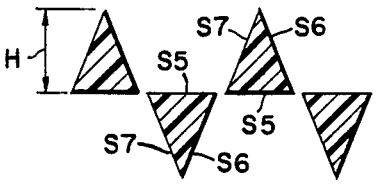
FIG. 6 is a sectional view taken along lines 6—6 of FIG. 2 showing the second embodiment.

FIGS. 5 and 6 illustrate that the cross sectional shape of the teeth shown in this embodiment is substantially triangular in shape, each having side surfaces S5, S6 and S7. Thus each tooth forms a three sided pyramid, the base of each pyramid lying in a plane perpendicular to the axis of each tooth.

The intersection of sides S5 and S6 forms an edge 36 while the intersection between sides S5 and S7 forms an edge 35. When in use, the facing edges 35 and 36 of adjacent teeth will begin to come closer to each other toward the base 32, so that the spacing D between adjacent teeth gets smaller to a point where particles of lice or nits 37 will be caught between the interacting edges of adjacent teeth.

As will be appreciated by comparing FIGS. 5 and 6, the length of each side will continually increase from the top 34 of each tooth toward the base 32. Similarly, the dimension H (FIG. 6) of each tooth will also increase.

The side S5 of each tooth lie along the same line when viewed in a cross section taken across the longitudinal axis of each tooth, as is seen in FIGS. 5 and 6. Alternatively, side S5 of alternating teeth, or every other tooth, may lie along the same line when the teeth are viewed in cross section, while the side S5 of the other teeth will lie along a line offset from the line passing through sides S5 of the first teeth as would be the construction of the embodiment of FIGS. 2 and 4. The edge of each tooth opposite side S5 is located at an angle of the cross sectional triangle which extends or points in a direction opposite to that of the corresponding angle of each adjacent tooth.

While the foregoing invention has been described and illustrated with respect to certain embodiments which provide satisfactory results, it will be appreciated, by those skilled in the art, after understanding the principles of the present invention, that various changes and modifications may be made without departing from the spirit and scope of the present invention, and it is therefore intended to cover all such changes and modifications in the appended claims.

What is claimed is:

1. A comb for removing lice and nits from hair comprising a base, a plurality of teeth extending substantially in the same direction away from the base, the longitudinal axis of each tooth being parallel to the longitudinal axis of each other tooth and substantially the same length, each said tooth having a triangular cross sectional shape forming a three sided pyramid, the sides of each such cross sectional triangle increasing in length from the free end of each tooth toward the base, so that the spacing between adjacent teeth narrows toward said base, the cross sectional triangle of each tooth having a base side and an apex opposite said base side, the base side of each cross sectional triangle of each tooth lying along the same line when the cross sectional plane of one tooth passes through each other tooth, each of the sides of said cross sectional shape of each tooth converging at a rounded top of each tooth, and the side walls of each triangular shaped tooth meet to form an edge at the intersection thereof, said teeth being arranged on said base so that said edge of each tooth which forms said apex of said cross sectional triangle extends in a direction opposite to the apex of the cross sectional triangle of each adjacent tooth.

2. The comb according to claim 1 wherein facing edges of adjacent triangular shaped teeth formed in part by the side of each tooth which forms the base side of each said triangle and which lie along said same line meet at a point approximately twenty percent of the length of said teeth from the base so that at said point the spacing between facing edges of adjacent teeth diminishes to zero.

3. The comb according to claim 2 wherein the length of each side of said cross sectional triangular shape increases from the top of said teeth torward the base so that the distance between facing sides of adjacent teeth diminishes from the top of said teeth toward the base.

4. The comb according to claim 3 wherein the base of each triangularly shaped teeth lie in the same plane.

5. The comb according to claim 1 wherein the side walls of each face of each tooth has a non-smooth surface.

* * * * *